US008811635B2

(12) United States Patent
Sridharan et al.

(10) Patent No.: US 8,811,635 B2
(45) Date of Patent: Aug. 19, 2014

(54) APPARATUS AND METHOD FOR DRIVING PARASITIC CAPACITANCES USING DIFFUSION REGIONS UNDER A MEMS STRUCTURE

(75) Inventors: Sucheendran Sridharan, McMurray, PA (US); John Matthew Muza, Venetia, PA (US)

(73) Assignee: Robert Bosch GmbH, Stuttgart (DE)

( * ) Notice: Subject to any disclaimer, the term of this patent is extended or adjusted under 35 U.S.C. 154(b) by 428 days.

(21) Appl. No.: 13/176,838

(22) Filed: Jul. 6, 2011

(65) Prior Publication Data

US 2013/0010990 A1 Jan. 10, 2013

(51) Int. Cl.
*H04R 25/00* (2006.01)

(52) U.S. Cl.
USPC ..... 381/190

(58) Field of Classification Search
USPC ..... 381/113, 116, 191, 190
See application file for complete search history.

(56) References Cited

U.S. PATENT DOCUMENTS

| | | | | |
|---|---|---|---|---|
| 7,391,873 | B2 * | 6/2008 | Deruginsky et al. | 381/113 |
| 2007/0286438 | A1 | 12/2007 | Hirade et al. | |
| 2008/0175417 | A1 | 7/2008 | Kok et al. | |
| 2009/0074211 | A1 | 3/2009 | Hirade et al. | |
| 2009/0101997 | A1 | 4/2009 | Lammel et al. | |
| 2010/0164068 | A1 | 7/2010 | Pennock | |
| 2010/0167430 | A1 | 7/2010 | Steele et al. | |
| 2011/0241137 | A1 * | 10/2011 | Huang et al. | 257/419 |

* cited by examiner

*Primary Examiner* — Davetta W Goins
*Assistant Examiner* — Amir Etesam
(74) *Attorney, Agent, or Firm* — Michael Best & Friedrich LLP

(57) ABSTRACT

A semiconductor microphone including a silicon substrate having a perimeter; an N-well diffused into the substrate at the perimeter; a deformable diaphragm disposed over at least a portion of the silicon substrate and in contact with at least a portion of the perimeter; and a signal channel in electrical communication with the diaphragm. The signal channel includes a microphone output channel and a feedback output channel. The diaphragm produces an electric signal on the signal channel in response to deformation of the diaphragm and a portion of the electric signal is transmitted on the feedback output channel to the N-well.

16 Claims, 3 Drawing Sheets

APPARATUS AND METHOD FOR DRIVING PARASITIC CAPACITANCES USING DIFFUSION REGIONS UNDER A MEMS STRUCTURE

BACKGROUND

The present invention relates to circuits for reduction of parasitic capacitance, in particular for use in a CMOS-MEMS microphone.

Parasitic capacitances in any electrical system tend to hurt the performance of the system. In the case of microelectromechanical systems (MEMS) based microphones, parasitic capacitances on the MEMS elements/structures results in loss of signal as sound/air pressure is converted to electrical signals which is referred to as loss of sensitivity. While some solutions to this problem have been proposed, these are unsatisfactory because they involve producing additional layers on the device and/or result in additional power consumption.

SUMMARY

In one embodiment, the invention provides a semiconductor microphone including a silicon substrate having a perimeter; an N-well diffused into the substrate at the perimeter; a deformable diaphragm disposed over at least a portion of the silicon substrate and in contact with at least a portion of the perimeter; and a signal channel in electrical communication with the diaphragm. The signal channel includes a microphone output channel and a feedback output channel. The diaphragm produces an electric signal on the signal channel in response to deformation of the diaphragm and a portion of the electric signal is transmitted on the feedback output channel to the N-well.

In another embodiment the invention provides a method of reducing parasitic capacitance in a semiconductor microphone. The method includes steps of providing a silicon substrate having a perimeter; diffusing an N-well into the substrate at the perimeter; disposing a deformable diaphragm over at least a portion of the silicon substrate and in contact with at least a portion of the perimeter; and providing a signal channel in electrical communication with the diaphragm. The signal channel includes a microphone output channel and a feedback output channel. The method further includes the steps of producing an electric signal on the signal channel in response to deformation of the diaphragm and transmitting a portion of the electric signal on the feedback output channel to the N-well to reduce parasitic capacitance.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
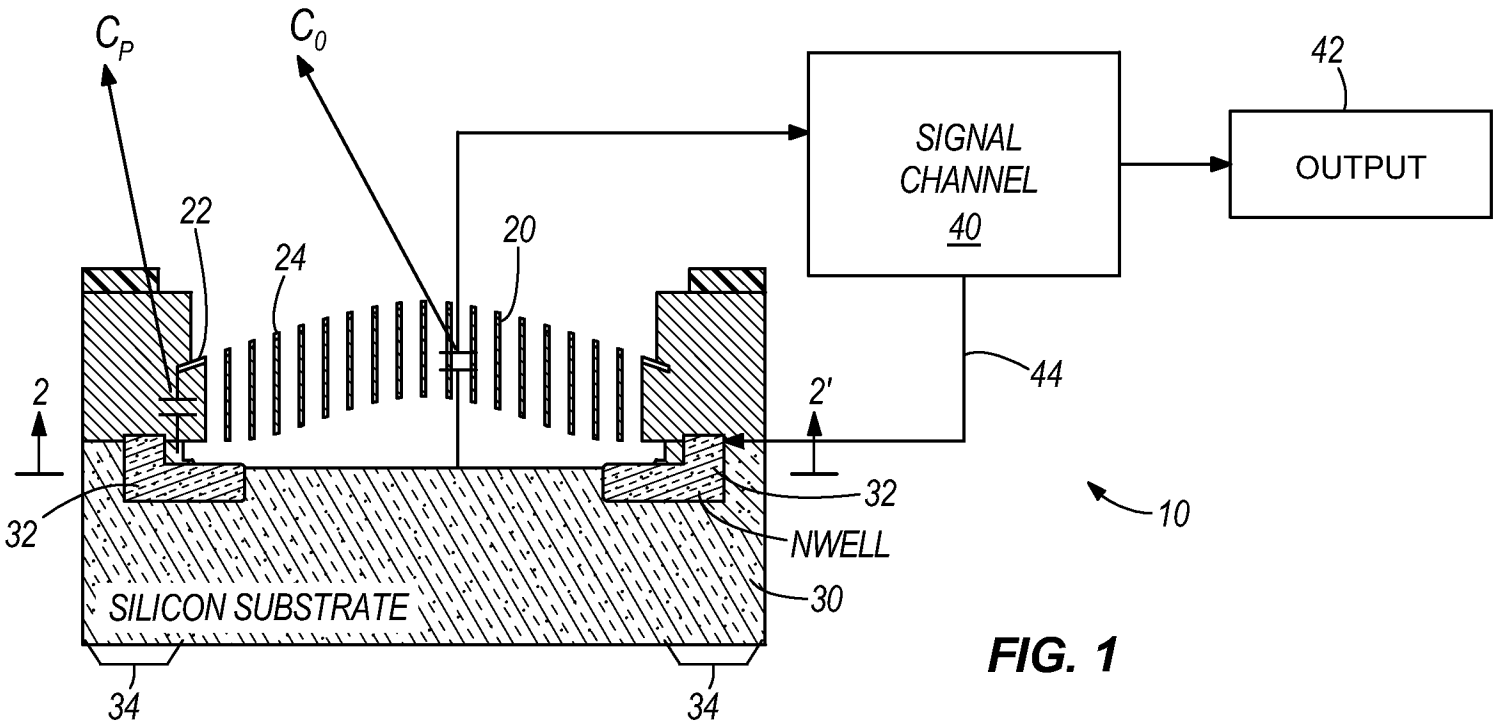
FIG. 1 shows a diagram of a CMOS-MEMS condenser microphone.

FIG. 1 shows an embodiment of a micro-electromechanical systems (MEMS) based device such as a microphone 10 which includes a movable or deformable diaphragm 20 attached to a back plate 30, where the back plate 30 is generally stationary, although in some embodiments the back plate 30 is also movable. The diaphragm 20 has a relatively constant amount of charge on it such that movements of the diaphragm 20 relative to the back plate 30 caused by sound waves change the shape and hence charge density and capacitance of the diaphragm 20. Changes in capacitance are indicative of sensed sounds. When sounds are impinging on the diaphragm 20 of the microphone 10, the moving diaphragm 20 creates a variable capacitance ($C_0$). The variable capacitance is converted into an analog voltage signal which may in turn be amplified by an on-chip output amplifier and converted into a digital output signal.

Nevertheless, not all portions of the diaphragm 20 are freely moveable. The edge regions 22 of the diaphragm 20 are held stationary relative to the device 10 while the more central portions 24 are flexible and move in response to impinging sound waves. The non-moving edge regions 22 of the diaphragm 20 contribute parasitic capacitance ($C_P$) that cause signal loss from the microphone 10.

To reduce or eliminate the parasitic capacitance $C_P$ caused by the non-moving portion of the diaphragm 20, embodiments of the disclosed system and method provide for creating a circular N-well 32 around the edges of the back plate 30, for example by diffusion during the fabrication process. The N-well 32 may be made shallow or deep, depending in part on the structure of the MEMS device and the manufacturing process flow of the device. While the examples herein depict a circular microphone 10 with a correspondingly circular diaphragm 20 and back plate 30, other shapes are possible, including oval, hemispherical, square, octagonal, and other curved or polygonal shapes. In any event, the amount of parasitic capacitance $C_P$ that can be driven is controlled by extending or shrinking the N-well region underneath the MEMS.

Figure 2:
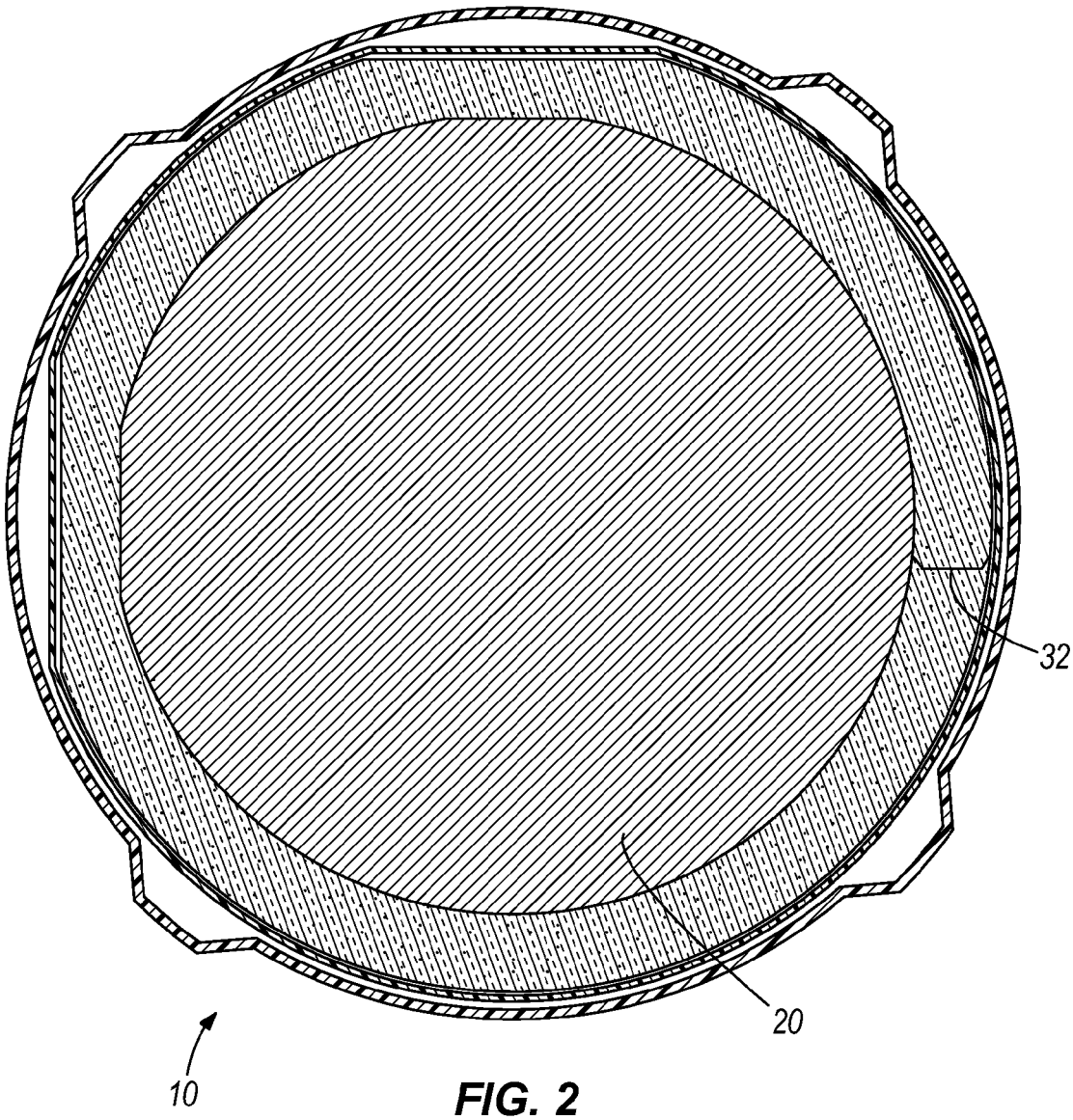
FIG. 2 a top cross-sectional view of a CMOS-MEMS condenser microphone through the line 2-2' in FIG. 1.
Figure 3A:
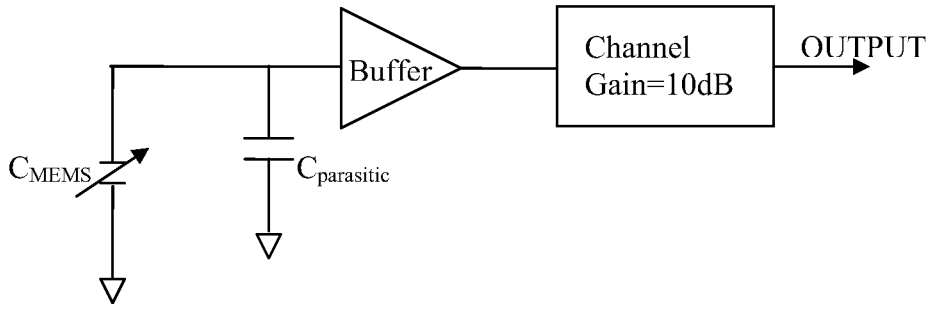
FIG. 3A shows an example of a circuit without a feedback branch that could be used with a MEMS device such as a microphone.
Figure 3B:
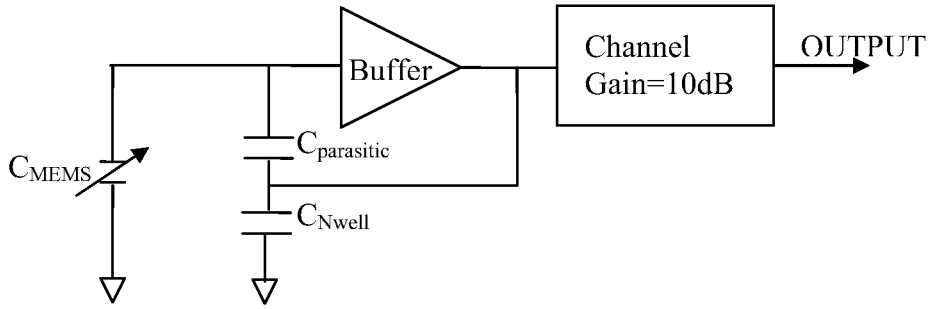
FIG. 3B shows an example of a circuit including a feedback branch that could be used with a MEMS device such as a microphone.

During operation, a voltage is applied to the N-well 32 to balance the charge on the opposite side of the diaphragm 20. In particular, parasitic capacitance $C_P$ is driven by feeding back a portion of the output signal from the diaphragm using a signal channel 40 (FIG. 1), the signal channel 40 including a microphone output channel 42 and a feedback output channel 44. Since the N-well 32 is aligned with the stationary edge region 22 of the diaphragm 20 (FIG. 2), driving the N-well reduces or eliminates the effects of the parasitic capacitance $C_P$. Signal channel 40 feeds back a portion of the output signal to the N-well 32. Signal channel 40 can be constructed using known methods. FIG. 3A shows an example of a circuit without a feedback branch that could be used with a MEMS device such as a microphone. FIG. 3B shows a similar circuit with the addition of a feedback branch in which the output of the buffer feeds back to the N-well to drive the capacitance in that portion of the device. In this case, if the buffer has a gain=1, then the top and bottom plate of the parasitic capacitance $C_P$ move together, hence the effect of $C_P$ as a load is canceled out. In various constructions, the gain of the buffer is greater than or less than 1 depending on the degree of parasitic capacitance in the system and other factors. The buffer is selected to have more than sufficient power to drive the extra $C_{Nwell}$ capacitance. When the gain is greater than 1, this may lead to a net loss of signal at the output 42, which might used for attenuation control.

In one particular embodiment, the microphone 10 may be constructed using CMOS-based MEMS technology (FIG. 1). In case of CMOS-MEMS microphone 10, the moving plate or diaphragm 20 may be a circular metal membrane (made from, e.g., the 'METAL1' layer) anchored along the perimeter 34 the base plate 30, where the base plate 30 may be a silicon substrate. A CMOS layer may be integrated into the base plate 30 or provided above the base plate 30. The diaphragm 20 may be anchored at one or more discrete locations along the perimeter 34 or it may be anchored continuously around the perimeter 34. As a result of the anchoring, there is little or no motion of the diaphragm 20 at the edge regions 22 while the more central portions 24 are flexible and are permitted to move.

In this particular embodiment, the METAL1-based membrane or diaphragm 20 acts as one plate of a capacitor while the silicon substrate/base plate 30 acts as the other plate. As discussed above, motion of the diaphragm 20 creates a change in capacitance. This charge is then translated to an electrical signal based on the conversion of charge (Q=CV).

Given that the membrane or diaphragm 20 acts as a capacitor that has a fixed charge of Q, then if the membrane moves (e.g. due to a change in air pressure as a result of impinging sound waves) the capacitance changes and hence voltage changes. This change in voltage creates the electrical output signal indicative of the applied acoustic pressure.

The change in voltage from membrane motion can be expressed by the formula:

$$\left(\frac{\Delta c}{C_0 + C_p}\right) V_{bias} = \Delta v$$

where $\Delta c$=change in capacitance due to membrane motion;

$C_0$=initial capacitance before membrane motion; and $C_P$=parasitic capacitance due to membrane edges and all other connections on that node.

As discussed above, although the membrane or diaphragm 20 may be a single, unitary structure it nevertheless includes moving and non-moving portions. The edge regions 22 of the diaphragm 20 are non-moving parts due to anchors that secure the diaphragm 20 to the base plate 30, or substrate. These non-moving portions act as a load, reducing the net change in voltage. The non-moving parts can be modeled as $C_P$ in the formula above. From the formula, it can be seen that $C_P$ reduces the output signal level or sensitivity.

Accordingly, the parasitic capacitance can be reduced or eliminated by driving $C_P$ with a portion of the output signal to compensate for the charge on the relatively stationary edge regions 22 of the diaphragm 20. In the formula above, it can be seen that if the parasitic capacitance $C_P$ changes with $\Delta c$, this effectively cancels out the $C_P$ term from the formula because the parasitic capacitor (i.e. the charge on the edge region 22) is neither gaining nor losing charge. This in turn results in a sensitivity boost at the output. One solution to this problem has been to introduce another conductive layer which is above the silicon substrate/base plate and below the METAL1 layer, for example a polysilicon layer, however this results in degradation of the output signal.

Accordingly, using an N-well structure created beneath the silicon substrate by a diffusion process during fabrication of the device, parasitic capacitance (including MEMS and circuit parasitic capacitances) can be driven without any signal-to-noise penalty and can boost the signal at the output.

Thus, the invention provides, among other things, an apparatus and method for driving parasitic capacitances using diffusion regions under a MEMS structure. Various features and advantages of the invention are set forth in the following claims.

What is claimed is:

1. A semiconductor microphone, comprising:

a silicon substrate having a perimeter;

an N-well diffused into the silicon substrate at the perimeter;

a deformable diaphragm disposed over at least a portion of the silicon substrate and in contact with at least a portion of the perimeter; and a signal channel in electrical communication with the deformable diaphragm, the signal channel comprising a microphone output channel and a feedback output channel, wherein the deformable diaphragm produces an electric signal on the signal channel in response to deformation of the deformable diaphragm, and wherein a portion of the electric signal is transmitted on the feedback output channel to the N-well to change a voltage of the N-well to at least partially compensate a parasitic capacitance on the deformable diaphragm.

2. The semiconductor microphone of claim 1, wherein the deformable diaphragm comprises a metal layer.

3. The semiconductor microphone of claim 1, wherein the deformable diaphragm is adjacent to and in continuous contact with the perimeter of the silicon substrate.

4. The semiconductor microphone of claim 1, wherein the semiconductor microphone comprises a CMOS layer.

5. The semiconductor microphone of claim 4, wherein the semiconductor microphone comprises a MEMS device.

6. The semiconductor microphone of claim 5, wherein the deformable diaphragm comprises a metal layer.

7. The semiconductor microphone of claim 1, wherein the deformable diaphragm is circular.

8. The semiconductor microphone of claim 7, wherein the deformable diaphragm is secured to the perimeter of the silicon substrate.

9. A method of reducing parasitic capacitance in a semiconductor microphone, comprising:

providing a silicon substrate having a perimeter;

diffusing an N-well into the silicon substrate at the perimeter;

disposing a deformable diaphragm over at least a portion of the silicon substrate and in contact with at least a portion of the perimeter; and providing a signal channel in electrical communication with the deformable diaphragm, the signal channel comprising a microphone output channel and a feedback output channel;

producing an electric signal on the signal channel in response to deformation of the deformable diaphragm; and transmitting a portion of the electric signal on the feedback output channel to the N-well to change a voltage of the N-well to at least partially compensate the parasitic capacitance on the deformable diaphragm.

10. The method of claim 9, wherein the deformable diaphragm comprises a metal layer.

11. The method of claim 9, wherein disposing a deformable diaphragm over at least a portion of the silicon substrate and in contact with at least a portion of the perimeter comprises disposing the deformable diaphragm adjacent to and in continuous contact with the perimeter of the silicon substrate.

12. The method of claim 9, wherein the semiconductor microphone comprises a CMOS layer.

13. The method of claim 12, wherein the semiconductor microphone comprises a MEMS device.

14. The method of claim 13, wherein the deformable diaphragm comprises a metal layer.

15. The method of claim 9, wherein the deformable diaphragm is circular.

16. The method of claim 15, wherein disposing a deformable diaphragm over at least a portion of the silicon substrate and in contact with at least a portion of the perimeter comprises securing the deformable diaphragm to the perimeter of the silicon substrate.

* * * * *